US008978577B2

(12) United States Patent
Yang et al.

(10) Patent No.: US 8,978,577 B2
(45) Date of Patent: Mar. 17, 2015

(54) WAXING DEVICE

(75) Inventors: Ming-Lu Yang, New Taipei (TW); Ya-Dong Zhang, Shenzhen (CN); Tian-En Zhang, Shenzhen (CN); Gao-Feng Du, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 136 days.

(21) Appl. No.: 13/444,091

(22) Filed: Apr. 11, 2012

(65) Prior Publication Data

US 2013/0019800 A1 Jan. 24, 2013

(51) Int. Cl.

| | |
|---|---|
| ***B24B 57/04*** | (2006.01) |
| ***B24B 57/00*** | (2006.01) |
| ***B05C 11/00*** | (2006.01) |
| ***B05C 21/00*** | (2006.01) |
| ***B24B 29/00*** | (2006.01) |

(52) U.S. Cl.

CPC ..... *B24B 57/04* (2013.01); *B24B 29/00* (2013.01); *B05C 21/00* (2013.01); *B05C 11/00* (2013.01)

USPC ..... 118/76; 118/712; 118/708

(58) Field of Classification Search

None

See application file for complete search history.

(56) References Cited

U.S. PATENT DOCUMENTS

| | | | | |
|---|---|---|---|---|
| 4,165,603 | A * | 8/1979 | Lattion | 57/296 |
| 4,244,176 | A * | 1/1981 | Shimizu et al. | 57/295 |
| 6,458,021 | B1 * | 10/2002 | Takeyama et al. | 451/302 |

FOREIGN PATENT DOCUMENTS

| | | |
|---|---|---|
| CN | 2332533 Y | 8/1999 |

* cited by examiner

*Primary Examiner* — Dah-Wei D Yuan

*Assistant Examiner* — Jethro M Pence

(74) *Attorney, Agent, or Firm* — Novak Druce Connolly Bove + Quigg LLP

(57) ABSTRACT

A waxing device is used for applying a waxing treatment to a polishing wheel, and includes a supporting assembly, an adjusting assembly, a driving mechanism, a mounting assembly, a motor, a wax block and a resisting mechanism. The supporting assembly includes a sliding rail, and the adjusting assembly is slidably positioned on the sliding rail; the driving mechanism is mounted on the adjusting assembly; the mounting assembly includes a mounting member positioned on the driving mechanism; the motor is mounted on mounting member; the wax block is positioned on the motor and rotated by the motor; the resisting mechanism is positioned on the supporting assembly and resists the adjusting assembly for adjusting a pressure applied to the polishing wheel during the waxing process.

14 Claims, 4 Drawing Sheets

WAXING DEVICE

BACKGROUND

1. Technical Field

The present disclosure relates a waxing device, generally to a waxing device of a polishing machine.

2. Description of Related Art

The housings of electronic devices need polishing to achieve a mirror finish. Polishing wheels of polishing machines may need a waxing treatment before using. Manual waxing is one method or procedure for such waxing treatment, but the whole procedure of manual waxing is both time and labor consuming. In addition, the waxing quality depends on the expertise and effort of the operators. In related art, waxing devices are applied to polishing wheels. However, pressures applied to the polishing wheels are non-uniform during the waxing process, which results in undue wear of the polishing wheels. Furthermore, such waxing devices need to adjust cutting tool after changing each new wax, and this consumes more time.

Therefore, there is room for improvement within the art.

BRIEF DESCRIPTION OF THE DRAWINGS

The elements in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
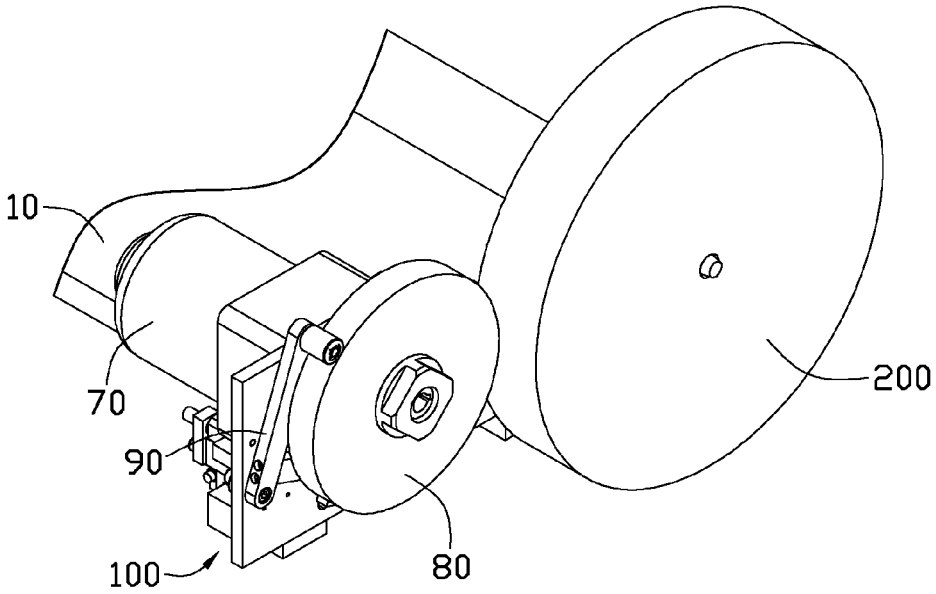
FIG. 1 is an isometric view of an embodiment of a waxing device assembled with a polishing wheel.
Figure 2:
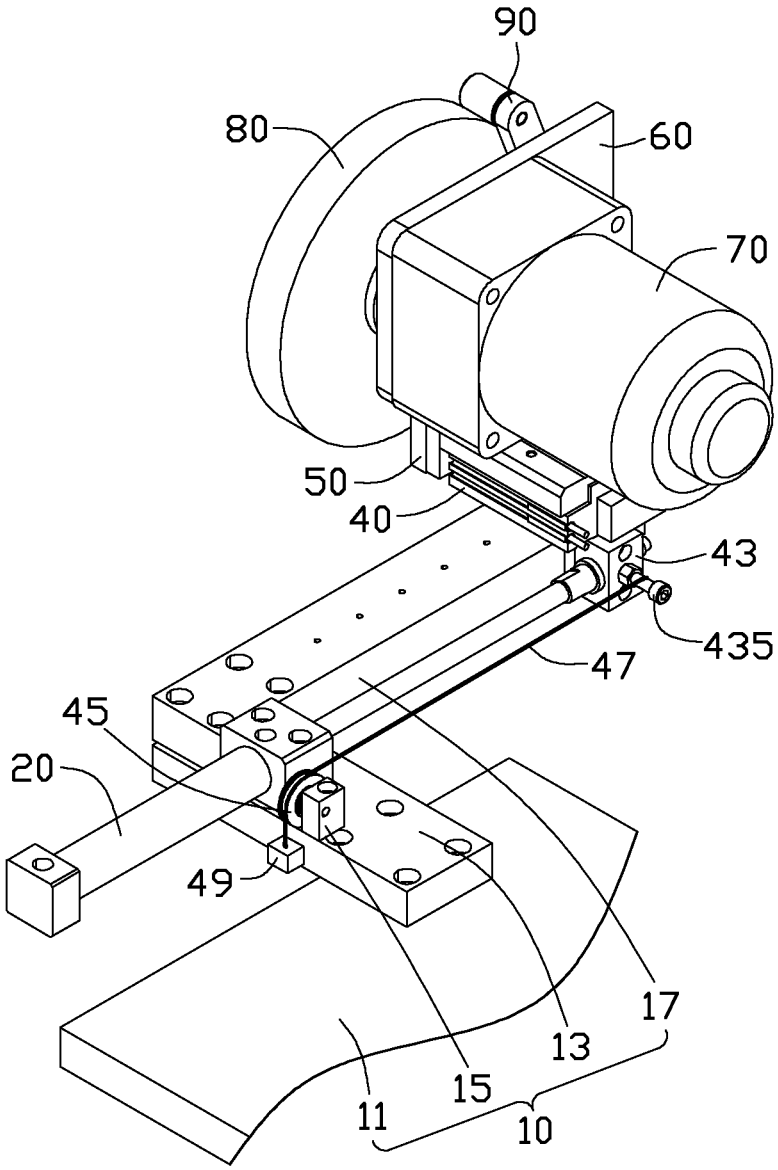
FIG. 2 is an assembled, isometric view of the waxing device of FIG. 1.

Referring to FIGS. 1 and 2, an embodiment of a waxing device 100 is assembled with a polishing wheel 200 of a polishing machine (not shown) for applying a waxing treatment. The waxing device 100 includes a supporting assembly 10, a resisting mechanism 20, an adjusting assembly 40, a driving mechanism 50, a mounting assembly 60, a motor 70, a wax block 80 and a detecting assembly 90. The resisting mechanism 20 is positioned on the supporting assembly 10. The adjusting assembly 40 is slidably positioned on the supporting assembly 10. The driving mechanism 50 is assembled with the adjusting assembly 40 for moving the mounting assembly 60. The mounting assembly 60 is positioned on the driving mechanism 50 for supporting the motor 70 and the wax block 80. The motor 70 is mounted on the mounting assembly 60 and configured for rotating the wax block 80. The wax block 80 is rotatably positioned on the shaft of the motor 70 for applying wax. The detecting assembly 90 is also installed on the mounting assembly 60 for detecting the consumption of the wax block 80. The resisting mechanism 20 resists the adjusting assembly 40 for adjusting a pressure of the wax block 80 applied to the polishing wheel 200 during the waxing procedure.

Figure 3:
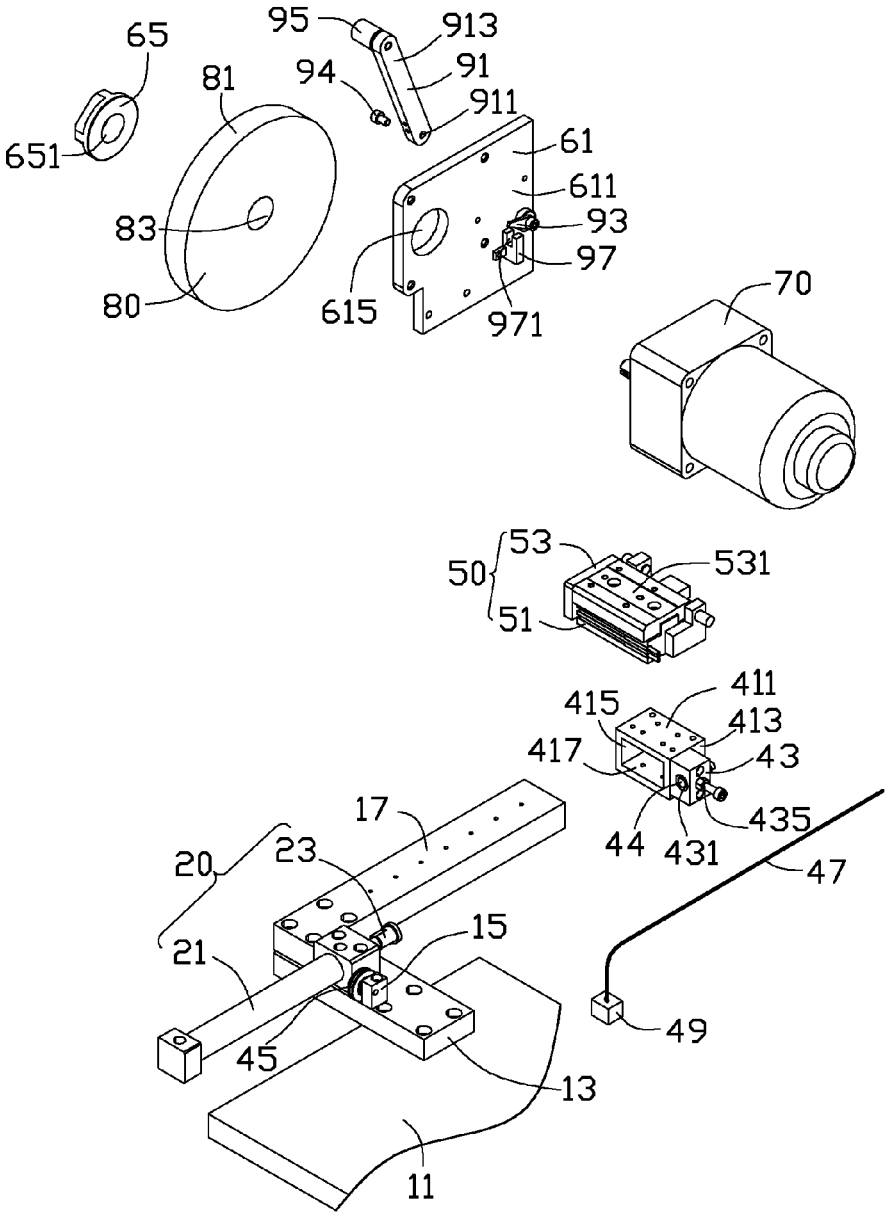
FIG. 3 is an exploded, isometric view of the waxing device of FIG. 2.
Figure 4:
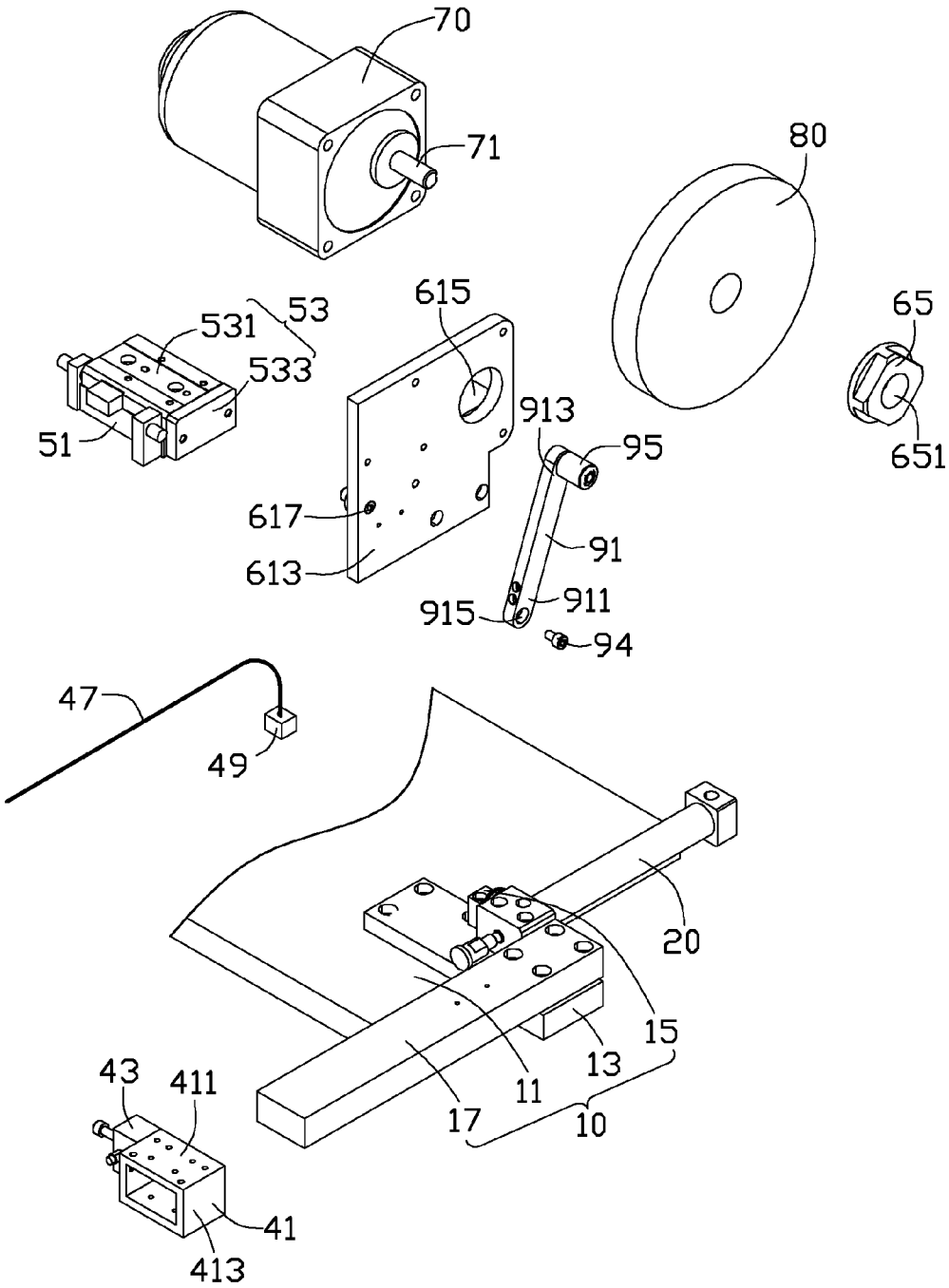
FIG. 4 is similar to FIG. 3, but viewed from another aspect.

Referring also to FIGS. 3 and 4, the supporting assembly 10 includes a supporting table 11, a supporting base 13, a fixing block 15, and a sliding rail 17. The supporting base 13 is substantially rectangular. One end of the supporting base 13 is fixed on the supporting table 11, and extends beyond an edge of the supporting table 11. The supporting base 13 is substantially perpendicular to a side edge of the supporting table 11. The fixing block 15 is positioned on the supporting base 13. The sliding rail 17 is positioned on an end of the supporting base 13 away from the supporting table 11, and extends outward substantially perpendicular to the supporting base 13.

The resisting mechanism 20 is mounted on the supporting base 13 for controlling the movement of the adjusting assembly 40. In the illustrated embodiment, the resisting mechanism 20 is cylindrical, includes a main body 21 and an extendable portion 23 movably positioned in the main body 21. The main body 21 is positioned on the supporting base 13 between the fixing block 15 and the sliding rail 17. The extendable portion 23 extends from an end of the main body 21 in the same direction along with the sliding rail 17.

The adjusting assembly 40 includes an adjusting base 41 (see FIG. 4), a mounting block 43, a sensor 44, a pulley wheel 45, an adjusting wire 47 and a hanging weight 49. The adjusting base 41 is substantially rectangular and slidably sleeves on the sliding rail 17. The adjusting base 41 includes a first sidewall 411, a second sidewall 413, a third sidewall 415, and a fourth sidewall 417. Two ends of the first sidewall 411 connect with the second sidewall 413 and the third sidewall 415, respectively. The first sidewall 411 is disposed opposite to the fourth sidewall 417. The second sidewall 413 is positioned opposite to the third sidewall 415 adjacent to the supporting assembly 10. The third sidewall 415 interconnects the first sidewall 411 and the fourth sidewall 417. The mounting block 43 is installed on the second sidewall 413. A resisting groove 431 corresponding to the extendable portion 23 is defined on a first surface of the mounting block 43 facing the extendable portion 23. A bolt 435 is positioned on a second surface of the mounting block 43 facing the supporting assembly 10 adjoining the first surface thereof.

The sensor 44 is received in the resisting groove 431 for detecting the action of the extendable portion 23. One end of the extendable portion 23 away from the main body 21 resists the sensor 44. The pulley wheel 45 is rotatably fixed to a side of the fixing block 15, such that the pulley wheel 45 is positioned between the resisting mechanism 20 and the fixing block 15. The adjusting wire 47 runs over the pulley wheel 45. One end of the adjusting wire 47 is connected with the bolt 435. The adjusting wire 47 is made of wear-resistant and durable material. In the illustrated embodiment, the adjusting wire 47 is made of steel. The hanging weight 49 is hung at another end of the adjusting wire 47 adjoining the pulley wheel 45 for adjusting the pressure of the wax block 80 applied to the polishing wheel 200. The waxing device 100 includes a number of hanging weights 49 which are each of a different weight, and are interchangeable. In an alternative embodiment, the adjusting wire 47 could be designed to be an endless wire loop, and the adjusting wire 47 connects the bolt 435 and the pulley wheel 45.

The driving mechanism 50 is positioned on the first sidewall 411. In illustrated embodiment, the driving mechanism 50 is a cylinder. The driving mechanism 50 includes a basing body 51 and a pushing member 53 movably positioned on the basing body 51. The basing body 51 is mounted on the first sidewall 411. The basing body 51 can drive the pushing member 53 into a reciprocating motion vertically with the sliding rail 17. The pushing member 53 includes a first connecting portion 531 and a second connecting portion 533. The first connecting portion 531 is movably positioned on the basing body 51. The second connecting portion 533 is substantially perpendicularly extending from an edge of the first connecting portion 531. The second connecting portion 533 is away from the mounting block 43.

The mounting assembly 60 is assembled with the second connecting portion 533. The mounting assembly 60 includes a mounting member 61 and a clamping element 65. The mounting member 61 is substantially a planar board. The mounting member 61 is installed on the second connecting portion 533. The mounting member 61 includes a first mounting surface 611 and a second mounting surface 613 positioned opposite to the first mounting surface 611. The first mounting surface 611 is adjacent to the driving mechanism 50. A shaft hole 615 and a mounting hole 617 are defined in the mounting member 61. An installing hole 651 is defined through the middle of the clamping element 65.

The motor 70 which includes a rotating shaft 71 is installed on the first mounting surface 611. The wax block 80 is substantially a thick disc with a through hole 83 in the middle thereof, and the periphery thereof is a round surface 81. The first rotating shaft 71 passes through the shaft hole 615 of the mounting member 61, the through hole 83 of the wax block 80, and finally assembles with the installing hole 651 of the clamping element 65. The wax block 80 rotatably sleeves on the first rotating shaft 71. The clamping element 65 sleeves on the first rotating shaft 71 and secures the wax block 80 in place.

The detecting assembly 90 is assembled with the mounting member 61 for detecting the consumption of the wax block 80. The detecting assembly 90 includes a detecting rod 91, a triggering end 93, a second rotating post 94, a detecting roller 95, and a detector 97. The detecting rod 91 includes a mounting end 911 and a detecting end 913. A rotating hole 915 is defined in the mounting end 911 and in the detecting end 913, respectively. The second rotating post 94 passes through the rotating holes 915 of the mounting end 911, the mounting hole 617 and the triggering end 93 for installing the detecting rod 91 on the second mounting surface 613 and the triggering end 93 on the first mounting surface 611. The triggering end 93 is able to rotate a same angle with the detecting rod 91 thereof. The detecting roller 95 is rotatably assembled with the detecting end 913 and rests lightly against the round surface 81. The detector 97 is positioned on the first mounting surface 611 between the motor 70 and the triggering end 93. A receiving groove 971 is formed in the detector 97 to receive the triggering end 93.

In assembly, the sliding rail 17 is fixed on the supporting base 13. The resisting mechanism 20 is positioned on the supporting base 13. The fixing block 15 is fixed on the supporting base 13. The adjusting base 41 and the pulley wheel 45 are assembled onto the sliding rail 17 and the fixing block 15, respectively. The mounting block 43 is mounted on the adjusting base 41. The extendable portion 23 resists the sensor 44. The driving mechanism 50 is connected with the first sidewall 411. The mounting member 61 is positioned on the second connecting portion 533. The motor 70 is positioned on the first mounting surface 611 so that the first rotating shaft 71 passes through the shaft hole 615. The wax block 80 and the clamping element 65 sleeve on the first rotating shaft 71. The wax block 80 is clamped between the clamping element 65 and the second mounting surface 613. The adjusting wire 47 hangs around the pulley wheel 45, and one end of the adjusting wire 47 is connected with the bolt 435. The hanging weight 49 hangs from the other end of the adjusting wire 47.

The wax block 80 is distant from the waxing wheel 200 at the beginning of the wax procedure. When the polishing wheel 200 needs to be waxed, the extendable portion 23 begins to draw or move backward, but doesn't leave the resisting groove 431. The sensor 44 detects action of the extendable portion 23 and begins to measure the waxing time. The adjusting base 41 also begins to move toward the polishing wheel 200 because of the decreasing resistance effect between the extendable portion 23 and the sensor 44. The driving mechanism 50, the mounting assembly 60, the motor 70 and the wax block 80 are also driven to move toward the polishing wheel 200 by the adjusting base 41.

The round surface 81 presses lightly on the surface of the polishing wheel 200 when the adjusting base 41 arrives at a preset position. The pushing member 53 begins to undergo a reciprocating motion when plumbed on the sliding rail 17. The wax block 80 is driven to rotate by the motor 70 and rotates the polishing wheel 200. The wax will be coated uniformly on the polishing wheel 200 by means of the friction between the wax block 80 and the polishing wheel 200. The extendable portion 23 pushes the mounting block 43 back to its initial position after the preset waxing time.

The detecting roller 95 resists against the round surface 81. The detecting rod 91 tilts with the decreasing diameter of the wax block 80. The triggering end 93 tilts accordingly toward the detector 97. The detector 97 issues a warning when the triggering end 93 arrives at within the receiving groove 971, which signifies that the wax block 80 needs to be changed or replaced. A new polishing wheel 200 is also needed when the wax block 80 becomes so worn out to the point that it cannot make contact with the polishing wheel 200 when the adjusting base 41 arrives at the preset position.

The waxing device 100 has a very simple arrangement and configuration. The adjusting base 41 slidably sleeves on the sliding rail 17. The resisting mechanism 20 resists the mounting block 43 for adjusting the pressure of the wax block 80 applied to the polishing wheel 200 during the waxing treatment procedure. The driving mechanism 50, the motor 70 and the wax block 80 are driven to move toward the polishing wheel 200 through the adjusting base 41. This means that the cutting tool adjusting process is not necessary when a new wax block 80 is substituted for a worn wax block 80. In addition, the circular wax block 80 replaces the traditional strip-shaped wax block. The wax block 80 retains a circular shape during this process. The wax block 80 is driven to move in two perpendicular directions, and this has the net result that allows for the wax to be coated uniformly on the polishing wheel 200. Furthermore, efficient consumption of the wax block 80 will be improved upon because the clamping of the wax block 80 requires the smallest possible area.

It is believed that the present embodiments and their advantages will be understood from the foregoing description, and it will be apparent that various changes may be made thereto without departing from the spirit and scope of the disclosure or sacrificing all of its material advantages.

What is claimed is:

1. A waxing device is used for waxing treatment to a polishing wheel, comprising:

a supporting assembly comprising a sliding rail;

an adjusting assembly slidably positioned on the sliding rail along a first direction, the adjusting assembly comprising an adjusting base, a pulley wheel, an adjusting wire, and a hanging weight;

the adjusting base slidably sleeved on the sliding rail, the pulley wheel rotatably positioned on the supporting assembly, the adjusting wire hanging around the pulley wheel, one end of the adjusting wire connected with the adjusting base via a bolt, and the hanging weight hung at another end of the adjusting wire;

a driving mechanism mounted on the adjusting assembly;

a mounting assembly comprising a mounting member positioned on the driving mechanism;

a motor mounted on the mounting member;

a wax block rotatably positioned on the motor and driven to rotate by the motor; and a resisting mechanism positioned on the supporting assembly and resisting the adjusting assembly configured to adjust a pressure applied to the polishing wheel during the waxing process, wherein the driving mechanism is configured to move the wax block along a second direction perpendicular to the first direction, and the resisting mechanism resists against the adjusting base, the pulley wheel is adjacent to the resisting mechanism.

2. The waxing device of claim 1, wherein the adjusting assembly further comprises a mounting block, the mounting block is positioned on one surface of the adjusting base adjoining the supporting assembly, the resisting mechanism resists the mounting block, one end of the adjusting wire is connected with the mounting block, and the hanging weight is hung at another end of the adjusting wire.

3. The waxing device of claim 2, wherein a resisting groove is formed on one surface of the mounting block corresponding to the resisting mechanism, and the resisting mechanism resists the resisting groove.

4. The waxing device of claim 2, wherein the adjusting assembly further comprises a sensor positioned on one surface of the mounting block facing the resisting mechanism, and the resisting mechanism resists the sensor.

5. The waxing device of claim 1, wherein the supporting assembly further comprises a supporting base and a supporting table, one end of the supporting base is fixed on the supporting table and extends beyond an edge of the supporting table, and the resisting mechanism is mounted on the supporting base.

6. The waxing device of claim 5, wherein the supporting base is connected with the supporting table.

7. The waxing device of claim 1, wherein the resisting mechanism comprises a main body and an extendable portion movably positioned in the main body, the main body is positioned on the supporting assembly; and the extendable portion extends from the main body and resists against the adjusting base.

8. The waxing device of claim 1, wherein the driving mechanism comprises a basing body positioned on the adjusting base and a pushing member movably positioned on the basing body, and the mounting member is installed on the pushing member.

9. The waxing device of claim 1, wherein the wax block is circular-shaped, and a round surface of the wax block is configured for touching the polishing wheel.

10. The waxing device of claim 1, wherein the waxing device further comprises a detecting assembly, the detecting assembly comprises a detecting rod, and a triggering end; the mounting member comprises a first mounting surface and the second mounting surface oppositely positioned to the first mounting surface; the detecting rod is rotatably positioned on the second mounting surface, the motor is positioned on the first mounting surface; the triggering end is rotatably assembled with the first mounting surface, and the triggering end is configured to rotate a same angle with the detecting rod when the detecting rod rotates.

11. The waxing device of claim 10, wherein the detecting assembly further comprises a detector, and the detector is positioned on the first mounting surface and between the triggering end and the motor.

12. The waxing device of claim 11, wherein a receiving groove is formed in the detector, and the triggering end is configured to resist a sidewall of the receiving groove.

13. The waxing device of claim 10, wherein the detecting assembly further comprises a detecting roller, the detecting rod comprises a mounting end and a detecting end opposite to the mounting end, the mounting end is rotatably positioned on the second mounting surface, the detecting roller is rotatably assembled with the detecting end, and the detecting roller resists a round surface of the wax block.

14. A waxing device is used for waxing treatment to a polishing wheel, comprising:

a supporting assembly comprising a sliding rail;

an adjusting assembly slidably positioned on the sliding rail;

a driving mechanism mounted on the adjusting assembly;

a mounting assembly comprising a mounting member positioned on the driving mechanism;

a motor mounted on the mounting member;

a wax block rotatably positioned on the motor and driven to rotate by the motor;

a resisting mechanism positioned on the supporting assembly and resisting the adjusting assembly configured to adjust a pressure applied to the polishing wheel during the waxing process; and a detecting assembly, the detecting assembly comprises a detecting rod, and a triggering end; the mounting member comprises a first mounting surface and the second mounting surface oppositely positioned to the first mounting surface; the detecting rod is rotatably positioned on the second mounting surface, the motor is positioned on the first mounting surface; the triggering end is rotatably assembled with the first mounting surface, and the triggering end is configured to rotate a same angle with the detecting rod when the detecting rod rotates.

* * * * *